United States Patent [19]

Rausch

[11] Patent Number: 5,024,707

[45] Date of Patent: Jun. 18, 1991

[54] PROCESS OF DECREASING THE INCRUSTATION IN PHOSPHATING PLANTS

[75] Inventor: Werner Rausch, Oberursel, Fed. Rep. of Germany

[73] Assignee: Metallgesellschaft Aktiengesellschaft, Frankfurt am Main, Fed. Rep. of Germany

[21] Appl. No.: 369,743

[22] Filed: Jun. 22, 1989

[30] Foreign Application Priority Data

Jul. 15, 1988 [DE] Fed. Rep. of Germany ..... 3824063

[51] Int. Cl.[5] ..... C23C 22/07

[52] U.S. Cl. ..... 148/253; 118/610; 427/436; 427/444

[58] Field of Search ..... 148/253, 243, 423, 425; 118/610; 427/436, 437, 438, 443.1, 444

[56] References Cited

U.S. PATENT DOCUMENTS

| | | | |
|---|---|---|---|
| 3,839,988 | 10/1974 | Duerr | 148/253 |
| 3,874,951 | 4/1975 | Hill | 148/253 |
| 3,971,539 | 7/1976 | Goto | 148/253 |
| 4,287,004 | 9/1981 | Murakami | 148/253 |
| 4,317,848 | 3/1982 | Mellerowicz | 148/253 |
| 4,322,251 | 3/1982 | Elliot | 148/253 |
| 4,361,605 | 11/1982 | Takahashi | 148/253 |
| 4,399,768 | 8/1983 | Tokushima | 148/253 |
| 4,400,416 | 8/1983 | Takahashi | 148/253 |
| 4,402,765 | 9/1983 | Goto | 148/253 |
| 4,459,531 | 9/1984 | Tokashima | 148/253 |
| 4,632,706 | 12/1986 | Mueller | 148/253 |

FOREIGN PATENT DOCUMENTS

| | | |
|---|---|---|
| 0040369 | 11/1981 | European Pat. Off. . |
| 1146325 | 6/1959 | Fed. Rep. of Germany . |

*Primary Examiner*—Jay H. Woo
*Assistant Examiner*—Jeremiah F. Durkin, II
*Attorney, Agent, or Firm*—Felfe & Lynch

[57] ABSTRACT

A process for retarding the formation of incrustation on plant parts in contact with phosphating solutions in phosphating plants and where the working phosphating solution immediately after contacting the metal surface to be phosphated and while the solution is at its working temperature is caused to flow to contact an additionally presented solid surface that is disposed outside the region in which the workpiece metal surface and phosphating solution contact each other. The ratio of the second solid surface area which is contacted by the phosphating solution in the phosphating plant to the surface area of the plant parts in contact with the phosphating solution is at least 2. The solid surfaces preferably consist of metal, metal alloy, ceramics, porcelain, metal oxide, metal phosphate, such as phosphate bath sludge, and/or alkali fluoroaluminate and may be formed as planar and/or profiled plates, regularly or irregularly shaped bodies, spheres, fragments, particulate or finely particulate bulk material beds, wire, chips and/or nonwoven fabrics and may optionally constitute a fixed bed or fluidized bed.

11 Claims, 1 Drawing Sheet

PROCESS OF DECREASING THE INCRUSTATION IN PHOSPHATING PLANTS

Background of Invention

Figure 1:
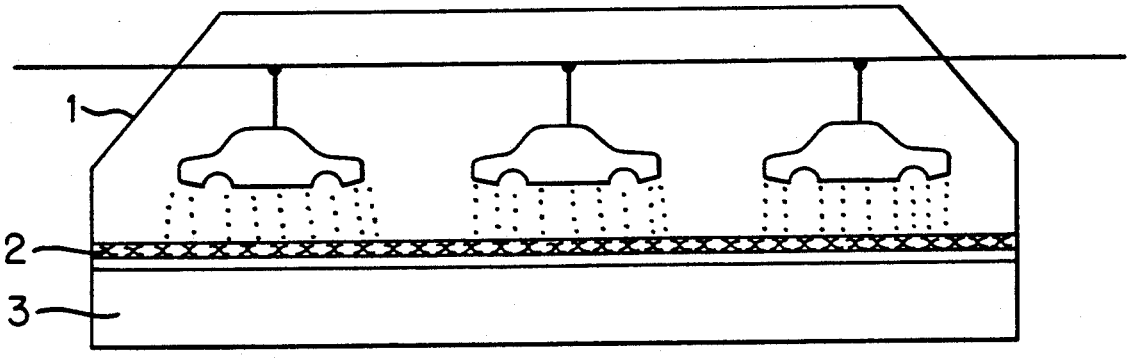

The present invention is in a process of retarding the formation of incrustation on plant parts in contact with phosphating solutions in phosphating plants.

It is known to use acid aqueous solutions, such as solutions of the phosphates of zinc, manganese, calcium, magnesium, nickel and/or iron, for the phosphating of metals, e.g., for protection against corrosion, for improving the adherence of paint and to facilitate sliding movements. Depending on the amount in which the phosphating baths are used to deposit phosphate layers on metals, such as steel, galvanized steel and aluminum, a sludge consisting of insoluble phosphate is formed in the phosphating bath. For instance, in the phosphating of steel, that sludge will consist of iron phosphate together with varying amounts of phosphates of the other divalent cations which are still contained in the phosphating bath. When aluminum is phosphated in fluoride-containing solutions, a sludge containing alkali fluoroaluminates is formed. The sludge which is formed per square meter of treated metal surface may amount, e.g., to between 1 and 15 $g/m^2$.

It is also known that the sludge does not merely form in suspension in the phosphating bath but may be deposited as crusts on the surfaces of plant parts which contact the phosphating bath. Such plant parts are, e.g., the inside surfaces of the bath container, the spray tunnel, pipes, nozzles, transporting means and heat exchangers. The crusts must be removed periodically to avoid disturbances in the operation of the phosphating plant. However, removal of the crusts involves undesired downtimes of the plant and associated costs.

Various measures have been attempted in an effort to decrease the formation of crusts. These measures include, inter alia, the decrease of the steady-state concentration of sludge in the phosphating bath by a desludging, which is continuously or periodically effected by sedimentation, filtration and centrifugation. The belief was that the tendency to form crusts on plant parts would decrease if there was a decrease of the concentration of sludge in the bath solution. Another proposal relates to an electric and/or magnetic control of the phosphating bath. Chemical processes and the provision of additives in the phosphating bath are also known as means for decreasing the amount at which sludge is formed and/or for causing the crusts to be formed on the plant parts in such a form that they can be more easily removed by mechanical action. However, the described measures have not been suitable to solve the incrustation problem in a fully satisfactory manner.

THE INVENTION

It is an object of the invention to provide a process for a decrease of the incrustation on the surfaces of plant parts in contact with phosphating solutions, e.g., on the basis of phosphates of zinc, manganese, calcium, magnesium, nickel and/or iron in phosphating plants, which will avoid the disadvantages of the known measures, particularly of the measures mentioned hereinbefore, and which is much more effective than the known measures.

That object is accomplished in that the process of the kind described first hereinbefore is carried out in accordance with the invention in such a manner that the working phosphating solution immediately after contacting the metal surface to be phosphated (workpiece surface) and while at its working temperature, is caused to contact a second solid surface which is presented in addition to the surface of the plant parts and is disposed outside the region in which the workpiece metal surface and phosphating solution contact each other, the ratio of the second solid surface being at least twice as big as the surface of the plant parts in contact with the phosphating solution.

The material of the second solid surface preferably consists of metal, such as steel, metal alloy, such as special steel, or of ceramics, porcelain, metal oxide, metal phosphate and/or alkali fluoroaluminate.

In a preferred embodiment of the invention, the second solid surface is in the form of planar and/or profiled plates, regularly or irregularly shaped bodies, spheres, fragments, particulate or finely particulate bulk material beds, wire, chips and/or nonwoven fabrics.

The expression "immediately after the contact with the metal surface to be phosphated" means that a contact of the phosphating solution with the surface of the plant parts prior to the contact with the second solid surface is to be avoided as far as possible.

In spraying plants this can be accomplished in that, e.g., the solution which is dripping from the phosphated metal surfaces is immediately caused to flow in contact with the second solid surface before the solution can contact larger surface portions of the plant parts. In the immersion process a liquid current, e.g., is generated in the phosphating bath by pumping, stirring and the like and immediately after the contact with the workpiece surface to be phosphated causes the phosphating bath to flow in contact with the second solid surface before the bath can contact the surface of the plant parts. The period of contact with the second surface is preferably at least about 2 seconds.

FIG. 1 shows a spray plant through which workpieces such as auto bodies are conveyed. In FIG. 1, a second solid surface in the form of aged sludge on a support 2 is shown. In FIG. 1 the phosphating solution is 3.

Alternatively, a suitable agitation may be imparted to the phosphating bath so that the carrier of the second solid surface will be kept in suspension in the phosphating bath close to the workpiece surface to be phosphated. In that case an abrasive attack of the carriers on the phosphate layer which has been formed must be avoided by a proper adjustment of the agitation.

Figure 2:
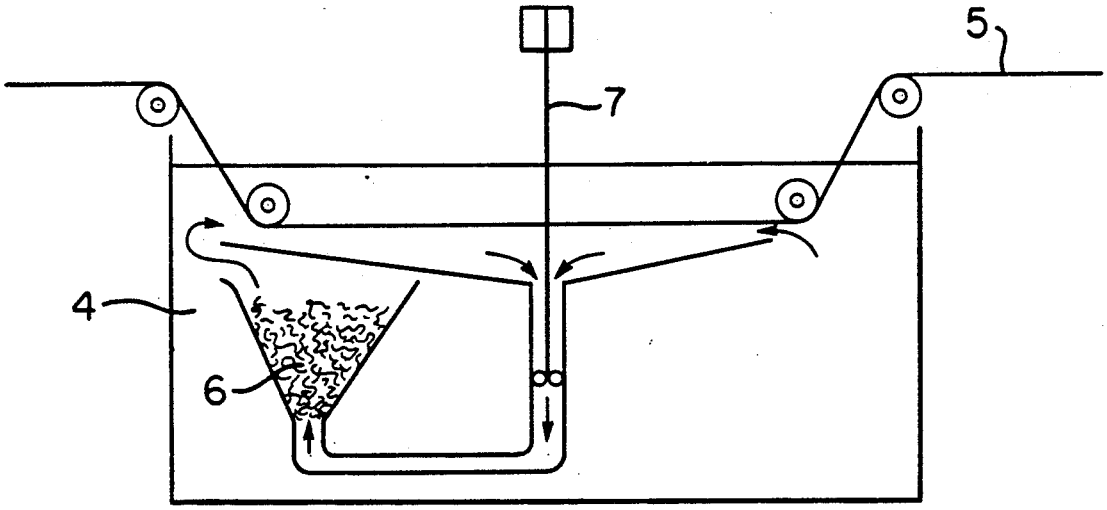

In FIG. 2 there is shown a phosphating bath 4 through which a steel wire 5 passes through a series of rollers. A surface and conduit leading to a funnel arrangement in which a second solid surface 6 is also shown. An impeller 7 creates agitation.

It has also been found that the second solid surface may desirably be in the form of a fixed bed or fluidized bed through which the phosphating solution passes or flows. When using a fluidized bed, the phosphating solution may be employed as the fluidizing medium If a fixed bed is used, the solution may optionally be sprayed onto the bed.

In a particularly desirable practice the second solid surface is in the form of phosphate bath sludge, preferably from the phosphating solution which is employed. That embodiment of the invention is in direct contrast to the previous practice, in which it was endeavored to remove the bath sludge from the circulation of the liquid of the working bath as soon as possible Because 1 g dry sludge has a surface area of about 0.1 to 30 $m^2$, that embodiment permits the presentation of second solid surface to the phosphating bath at low cost The phosphate sludge which constitutes the second solid surface is more effective if that sludge has been aged by a storage and/or heating preferably at about 60° C. or more for a period of about 24 hours in a wet state and/or by a storage and/or heating in a previously dried state before the sludge is used.

The effectiveness of the process in accordance with the invention may possibly be due to the fact that the volume portions of the phosphating solution which have contacted the workpiece surface to be phosphated are generally supersaturated with respect to insoluble tertiary metal phosphates and tend to establish a balance by a separation of sludge. Because the nucleation required for a crystallization of sludge particles in a clear solution is a very slow process compared to the growth on surfaces in contact with the phosphating solution, the sludge will preferentially be separated on such surfaces. Unless the process in accordance with the invention is employed, the surfaces are constituted to a substantial extent by those parts of the plant which are in contact with the working phosphating solution. On the other hand, if "a second solid surface" for a crystallization from the supersaturated phosphating solution is available in addition to the surface of the plant parts, the rate of incrustation on the plant parts of the phosphating plant proper will be decreased decisively.

The process of the invention will be explained more in detail by way of the following Examples with reference to FIGS. 1 and 2.

EXAMPLE 1

In a spraying plant for phosphating sheet metal parts made of steel, a phosphating solution having the following composition is used in the layer-forming stage:

| | | |
|---|---|---|
| 0.8 g/l Zn | Free acid: | 1.4 |
| 0.5 g/l Ni | Total acid: | 23.1 |
| 0.023 g/l Fe(III) | Bath temperature: | 55° C. |
| 4.45 g/l Na | Treating time: | 2 min. |
| 14.1 g/l $P_2O_5$ | | |
| 2.0 g/l $NO_3$ | | |
| 1.5 g/l $ClO_3$ | | |
| 0.1 g/l $NO_2$ | | |

The bath solution was replenished with an aqueous concentrate having the following composition:

25% by weight $P_2O_5$
5.3 % by weight Zn
2.85% by weight Na
1.0 % by weight Ni
0.5 % by weight Fe(III)
3.85% by weight $ClO_3$
2.28% by weight $NO_3$ to maintain a constant concentration of zinc and was also replenished with sodium nitrite to maintain a constant concentration of nitrite.

The plant was initially operated in the usual manner with a tilted plate clarifier arranged outside the bath container and with a recycling of the solution from which the sludge had been removed to the bath. Under these conditions the bath container wall was subject to an incrustation at a rate of about 1 mm/day.

Thereafter the plant was operated in accordance with the invention in that a fixed bed of granulated aged phosphate sludge from the plant was installed under the spray tunnel and the phosphating solution drained from the metal surface to be treated flowed through said bed before entering the bath proper (ratio of the surface of second solid to surfaces of plant parts 8:1), see FIG. 1. The sludge collecting in the bath was removed in the usual manner by a tilted plate clarifier. In that mode of operation the rate of incrustation on the bath wall amounted to only about 0.2 mm/day, i.e., it was much lower than in the control experiment.

EXAMPLE 2

In a strandline immersion plant, steel wire was phosphated with a solution composed as follows:

| | | |
|---|---|---|
| 34.6 g/l Zn | Free acid: | 14.7 |
| 7.7 g/l Na | Total acid: | 100 |
| 0.04 g/l Ni | Bath temperature: | 75° C. |
| 0.006 g/l Cu | Treating time: | 25 sec. |
| 65.0 g/l $NO_3$ | | |
| 29.7 g/l $P_2O_5$ | | |
| 1.25 g/l F | | |
| 0.2 g/l $NO_2$ | | |

The bath solution was replenished with an aqueous concentrate composed of:

28.5 % by weight $P_2$Ohd 5
12.2 % by weight Zn
0.6 % by weight Na
0.029% by weight Cu
0.018% by weight Ni
13.8 % by weight $NO_3$
0.5 % by weight F to maintain a constant number of points and was replenished with sodium nitrite to maintain a constant concentration of nitrite.

The plant was initially operated in the conventional manner with only a slight agitation of the bath and a slow sedimentation of sludge on the bottom of the phosphating bath. The separated sludge was mechanically removed from the bath from time to time. The rate of incrustation on the bath wall amounted to about 3 mm/day.

Means for effecting a forced circulation were then installed in the bath so that bath liquid from the bath portion through which the wires were passed was brought into close contact with previously settled sludge (ratio of the surface of second solid to the surface of plant parts in contact with phosphating solution 12:1, see FIG. 2. The solution from which sludge had substantially been removed was recycled to the bath region through which the wires were passed. In that mode of operation the rate of incrustation amounted to only about 0.5 mm/day, i.e., it was much lower than the control value. Desludging was effected in the usual manner but a certain concentration of sludge was maintained in the bath so that the process in accordance with the invention could be carried out continuously.

It will be understood that the specification and examples are illustrative but not limitative of the present invention and that other embodiments within the spirit and scope of the invention will suggest themselves to those skilled in the art.

I claim:

1. A process for decreasing the incrustation on plant parts in contact with a phosphating solution in a phosphating plant, comprising: contacting the phosphating solution with a workpiece metal surface; and immediately thereafter while at its working temperature and prior to its contact with the surface of plant parts causing the phosphating solution to contact a second solid surface, which surface is presented in addition to the surface of the plant parts said additionally presented second solids surface being disposed outside of a contact area of the workpiece metal surface with the phosphating solution, the ratio of the second solid surface which is contacted by the phosphating solution to the surface of the plant parts in contact with the phosphating solution being at least 2.

2. The process of claim 1 wherein the second solid surface consists of at least one selected from the group consisting of metal, ceramics, metal oxide, metal phosphate and alkali fluoroaluminate.

3. The process of claim 1 wherein the second solid surface is in the form of a plate, a sphere, a fragment, particulate material, wire, and nonwoven fabric.

4. The process of claim 1 wherein the second solid surface is in the form of a fixed bed through which the phosphating solution passes.

5. The process of claim 1 wherein the second solid surface is constituted by phosphating bath sludge.

6. The process of claim 5 wherein the sludge is from the phosphating solution that is employed.

7. The process of claim 5 wherein the phosphating bath sludge has been aged by being stored.

8. The process of claim 5 wherein the phosphating bath sludge has been heated.

9. The process of claim 8 wherein the sludge is heated at about 60° C. or more for a period of about 24 hours.

10. The process of claim 7 wherein he phosphating bath sludge has been heated.

11. The process of claim 1 wherein the second solid surface is in the form of a fluidized bed through which the phosphating solution passes.

* * * * *